US005273404A

United States Patent [19]

Wu

[11] Patent Number: 5,273,404

[45] Date of Patent: Dec. 28, 1993

[54] TUBULAR SHAFT MOTOR AND PUMP ASSEMBLY

[76] Inventor: Hung-Chin Wu, No. 15, Lane 23, Juian Street, Taipei, Taiwan

[21] Appl. No.: 901,120

[22] Filed: Jun. 19, 1992

[51] Int. Cl.[5] ..... F04B 17/00

[52] U.S. Cl. ..... 417/350; 417/366

[58] Field of Search ..... 417/350, 244, 356, 366, 417/367

[56] References Cited

U.S. PATENT DOCUMENTS

| | | | |
|---|---|---|---|
| 2,698,129 | 12/1954 | Troller et al. | 417/350 |
| 3,022,739 | 2/1962 | Herrick et al. | 417/350 X |
| 3,141,416 | 7/1964 | Bolan et al. | 417/350 X |
| 3,143,972 | 8/1964 | Smith et al. | 417/356 |
| 3,276,382 | 10/1966 | Richter | 417/356 X |
| 3,500,755 | 3/1970 | Gibson | 417/350 X |
| 4,204,810 | 5/1980 | Vogel | 417/244 |
| 5,017,087 | 5/1991 | Sneddon | 417/356 X |

FOREIGN PATENT DOCUMENTS

| | | | |
|---|---|---|---|
| 210273 | 1/1924 | United Kingdom | 417/356 |

*Primary Examiner*—Richard E. Gluck

*Attorney, Agent, or Firm*—Jacobson, Price, Holman & Stern

[57] ABSTRACT

A tubular shaft motor and pump assembly for the transmission of gas, liquid, and mixed fluids. The tubular shaft motor comprises a tubular housing; a union plate at each end of the tubular housing; a tubular stator mounted within the housing; and a tubular rotor coaxially mounted within the stator to a rotatable tubular shaft. Near each end of the rotatable tubular shaft, there is a bearing which rotatably connects the tubular shaft to the union plates located at each end of the housing. At least one end of the rotatable shaft is connected to a rotatable seat which houses an impeller and an impeller support, both of which rotate along with the rotatable tubular shaft. A pump assembly is thus defined at at least one end of the motor's tubular housing. Preferably, each pump assembly is contained within a tubular housing, which tubular housing has the same diameter as the tubular housing of the motor. The end of the tubular housing of the pump assembly that is not connected to the union plate, is closed off by an end plate. The end plate, in turn, is designed to receive a joint support which connects a delivery pipe to the pump assembly.

19 Claims, 6 Drawing Sheets

TUBULAR SHAFT MOTOR AND PUMP ASSEMBLY

BACKGROUND OF THE INVENTION 1. Field of the Invention

The present invention relates to a tubular shaft motor and pump assembly for the transmission of gases, liquid or mixed fluids. 2. Description of the Related Art Traditional fluid transmitting devices can be generally divided into two different types, namely, the impeller pump and the cascade pump.

FIG. 6 illustrates a conventional impeller pump. The impeller pump includes an impeller (B) inside a delivery pipe (A); and a shaft (C) connected to the impeller (B) and passing through the delivery pipe (A) to connect with the motor (M). The motor (M) transmits power to the shaft (C) which, in turn, causes the impeller (B) to turn. The fluids flow up as indicated by the arrows in FIG. 6. With larger transmitting capacity and shorter lift, this type of device is usually used in the discharge of fluid, irrigation, etc.; but has the following shortcomings:

1. The coaxial relationship between the motor (M) and the shaft (C) is critically important and must be maintained precisely in this structure. Any imprecision will cause the motor (M) to not work smoothly. In order to avoid this problem, universal joints, gear couplings or flange joints have been added between the motor and the shaft. This, however, not only increases production cost but also increases the likelihood of machine break-down.

2. The conventional impeller pump is also noisy because of noise generated by the contact between external moving parts.

3. The conventional impeller pump also requires a large mounting base for installing the motor (M) and pump. Consequently, space in the installation area becomes limited.

4. To assure that the impeller pump runs properly, a certain gap must be maintained between the blades and the delivery pipe (A). Such gaps create small vacuum areas which result in a significant loss in overall efficiency. In the case of an electrically powered motor, this loss in efficiency leads to wasted electricity.

FIG. 7 illustrates a conventional cascade pump. The cascade pump includes a rotary vane (E) inside a housing (D), and a shaft (F) in the center of the rotary vane (E) extending outside the housing (D) and connecting with the motor (M). When rotational power supplied by the motor (M) turns shaft (F) and the rotary vane (E), fluids at the intake (D1) are sucked into the housing (D) and are turned by the rotary vane (E) and subsequently output from the discharge (D2). Because of deflector (D3), fluids are expelled out through discharge (D2) in a vertical direction as indicated by the arrows shown in FIG. 7. With higher lifting ability and smaller transmitting capacity, this type of pump is usually used in tall buildings and mansions but has the following disadvantages:

1. As in the case of the impeller pump, a precise coaxial relationship must be maintained between the motor (M) and the shaft (C). This not only increases production cost but also the possibility of machine break-down.

2. In addition, the conventional cascade pump is noisy because of noise generated by the complicated structures and devices.

3. The conventional cascade pump also suffers from significant losses because of the circular flow and the friction developed within the pumps. In particular, the fluid flow is in a circular direction after the fluid is sucked into the intake (D1). There is consequently a long transmitting distance, as well as friction between the deflector (D3) and the inner wall of the housing (D). This, in turn, creates significant losses in efficiency during the transmitting process.

SUMMARY OF THE INVENTION

A primary object of the present invention is to overcome the disadvantages of the foregoing devices by doing away with the complicated structures and conventional pump arrangements having a solid shaft to thus provide high transmission efficiency, small installation space and compatibility with various fluid transmitting arrangements.

To achieve this and other objects, the present invention comprises a tubular shaft motor and pump assembly for transmitting gas, liquid or mixed fluids. The tubular shaft motor comprises a tubular housing; a union plate at each end of the tubular housing; a tubular stator mounted within the housing; and a tubular rotor coaxially mounted within the stator to a rotatable tubular shaft. Near each end of the rotatable tubular shaft, there is a bearing which rotatably connects the tubular shaft to the union plates located at each end of the housing. At least one end of the rotatable shaft is connected to a rotatable seat which houses an impeller and an impeller support, both of which rotate along with the rotatable tubular shaft. A pump assembly can be thus defined at each end of the motor's tubular housing.

Preferably, each pump assembly is also contained within a tubular housing, which tubular housing has the same diameter as the tubular housing of the motor. This way, the tubular housing of the pump assembly can be connected using one of the union plates to the tubular housing of the motor so that a continuous tubular structure is defined by the tubular motor and pump assembly. The end of the tubular housing of the pump assembly that is not connected to the union plate, is closed off by an end plate. The end plate, in turn, is designed to receive a joint support which connects a delivery pipe to the pump assembly. A rotatable section of pipe extends out from the ends of the rotatable seats, which ends are opposite from the rotatable shaft of the tubular shaft motor. A bearing rotatably connects each of these rotatable sections of pipe to the joint support. A substantially linear fluid path is thus established from one delivery pipe, through the rotatable sections of pipe, through the rotatable seats, and through the rotatable tubular shaft of the motor, to another delivery pipe.

By selectively using different impellers (mixed flow impellers and highly skewed impellers), fluid flow can be established with either moderate pressure and low volume, or low pressure and moderate volume. As a result of the foregoing, the following can be achieved:

1. Shortening of the transmission path: While conventional motors use a fluid flow outside of the motor, the present invention establishes a substantially linear fluid flow through the tubular shaft of the motor. This advantageously results in a shorter transmission path.

2. Compact overall structure: The need for a large base in the case of conventional motors is altogether eliminated. Accordingly, a compact overall structure is achieved.

3. Long life of motor: Since the fluids pass directly through the tubular shaft, heat is not only dissipated from the outside of the motor, but is also dissipated internally by the fluid passing there through. Accordingly, the chance of overheating is reduced thus increasing the motor's life expectancy and decreasing machine break-down rate.

4. Reduction of noise: Because fluids are delivered internally through the tubular shaft in the motor, the motor and pump assembly of the present invention are less noisy than conventional devices.

5. Less wear and tear of parts: Because the input and output fluid flows are in a counter balance situation, there is less wearing of individual parts in accordance with the present invention.

6. High efficiency transmission of fluids: A short transmission path and the use of two different pairs of impellers provide a high fluid transmitting efficiency.

7. Connection versatility: The structure of the tubular shaft motor and pump assembly lends itself to, inter alia, series connections to thereby increase fluid lifting capacity and length of transmission.

BRIEF DESCRIPTION OF THE DRAWINGS

The invention will now be described with reference to the following drawings, wherein:

FIGS. 3, 3-1 and 3-2 illustrate the individual components which make up the embodiments shown in FIGS. 1 and 2.

DESCRIPTION OF THE PREFERRED EMBODIMENTS

Figure 1:
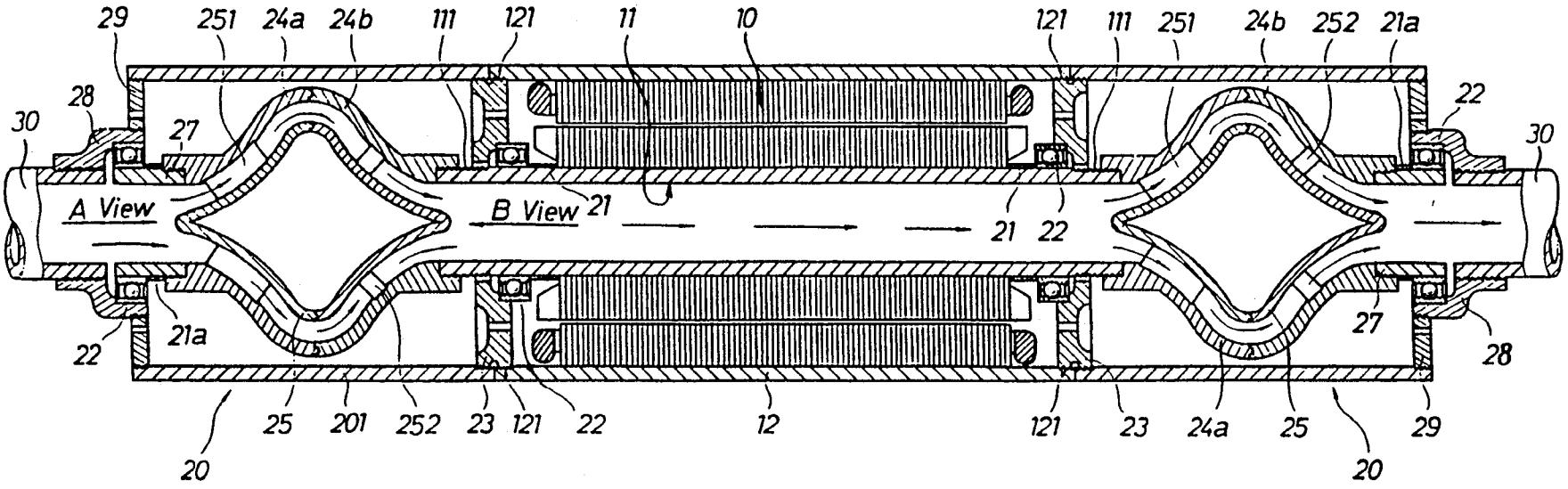
FIG. 1 is a cross section of the tubular shaft motor and pump assembly using a mixed flow impeller in accordance with a preferred embodiment of the present invention.

With reference to FIGS. 1-5, two preferred embodiments of the present invention will now be described. The differences between the two embodiments lie only in the impeller and support thereof, as well as the rotatable seat; the other parts are essentially the same from one embodiment to the other. Accordingly, there will be only one description of the two embodiments with an explanation of the differences.

According to the two aforementioned preferred embodiments, the present invention comprises a tubular shaft motor 10 and a pump assembly 20 for transmitting gas, liquid or mixed fluids.

The tubular shaft motor 10 comprises a tubular housing 12; a union plate 23 at each end of the tubular housing 12; a tubular stator mounted within the housing 12; and a tubular rotor coaxially mounted within the stator to a rotatable tubular shaft 11. Near each end of the rotatable tubular shaft 11, there is a bearing 22 which rotatably connects the tubular shaft 11 to the union plates 23 located at each end of the housing 12.

Each end of the rotatable shaft 11 is threadedly connected to a rotatable seat 24 which houses an impeller 251, 261 and an impeller support 25,26, both of which rotate along with the rotatable tubular shaft 11. A pump assembly 20 is thus defined at each end of the motor's tubular housing 12.

Preferably, each pump assembly 20 is contained within a tubular housing 201, which tubular housing 201 has the same diameter as the tubular housing 12 of the motor 10. This way, the tubular housing 201 of the pump assembly 20 can be connected using one of the union plates 23 to the tubular housing 12 of the motor 10. A continuous tubular structure is thus defined by the tubular motor 10 and pump assemblies 20.

The end of the tubular housing 201 of the pump assembly 20 that is not connected to a union plate 23, is closed off by an end plate 29. The end plate 29, in turn, is designed to receive a joint support 28 which connects a delivery pipe 30 to the pump assembly 20.

A rotatable section of pipe 27 extends out from the ends of the rotatable seats 24, opposite from the rotatable shaft 11 of the tubular shaft motor 10. A bearing 22 rotatably connects each of these rotatable sections of pipe 27 to the joint support 28. In particular, an exterior surface of the rotatable section of pipe 27 includes threads 271 which engage a set of internal threads 241 in the rotary seat 24. Similarly, internal threads 282 are provided in the joint support 28, which internal threads 282 mate with threads on the exterior surface of each delivery pipe 30. In addition, external threads 283 on the joint support 28 and internal threads 291 in the end plate 29 are used to connect the joint support 28 to the end plate 29.

A substantially linear fluid path is therefore established from one delivery pipe 30, through the rotatable sections of pipe 27, through the rotatable seats 24, and through the rotatable tubular shaft 11 of the motor 10, to another delivery pipe 30.

In addition, several vent holes 292 are disposed through the end plate 29.

Preferably, the motor's housing 12 and the housing 201 for the pump assembly 20 both have internal threads 121 at the longitudinal ends thereof. Likewise, there are external threads 233 about the circumference of each union plate 23, which external threads 233 are received by the internal threads 121 of the housings 12 and 201 to thereby connect the housings 12 and 201 to one another.

In addition, a collar 21 is provided circumferentially around the ends of the tubular shaft 11 for maintaining the spacing between the rotor and the bearings 22 at each end of the tubular shaft 11. Another similar collar 21*a* is provided circumferentially around the rotatable section of pipe 27 to maintain the spacing between the rotatable seat 24 and the bearing 22 which sits between the rotatable section of pipe 27 and the joint support 28. Preferably, the union plate 23 includes several cooling vents 232.

By selectively using different impellers (mixed flow impellers 251 and highly skewed impellers 261), fluid flow can be established with either moderate pressure and low volume, or low pressure and moderate volume.

Figure 2:
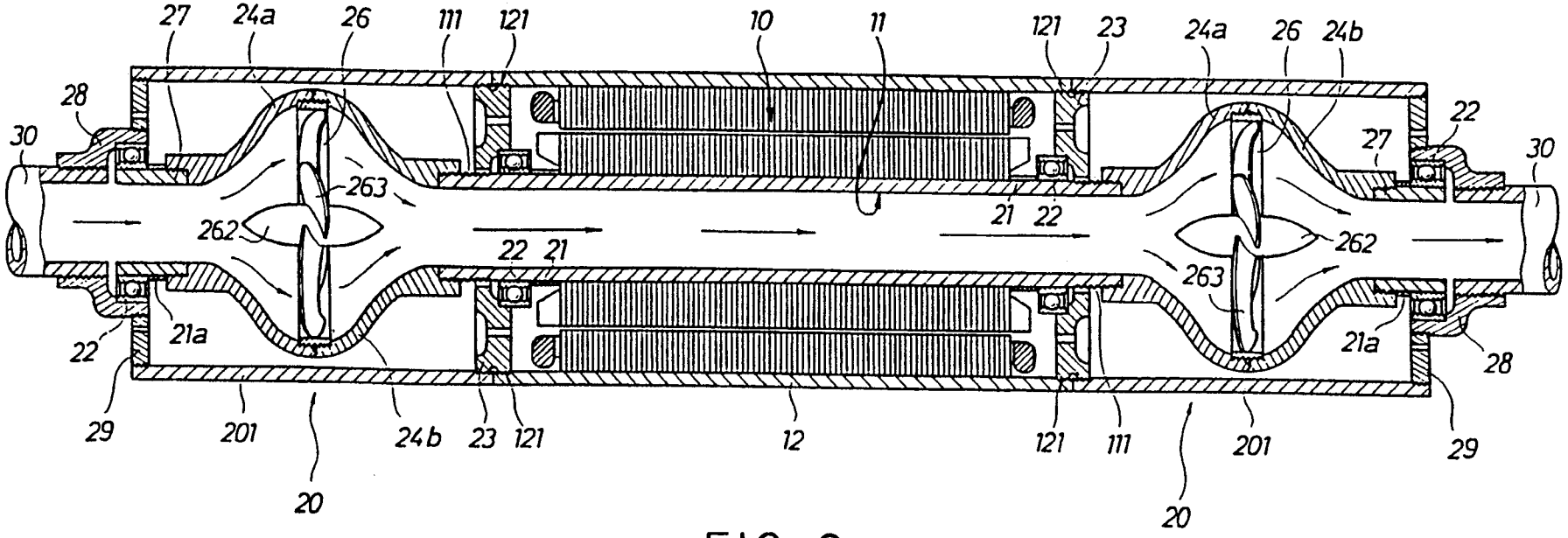
FIG. 2 is a cross section of the tubular shaft motor and pump assembly using a highly skewed impeller in accordance with another preferred embodiment of the present invention.
Figures 2, 3:
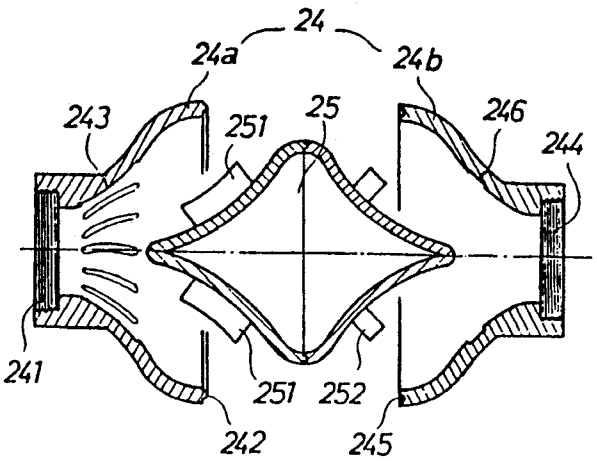
Figures 1, 3:
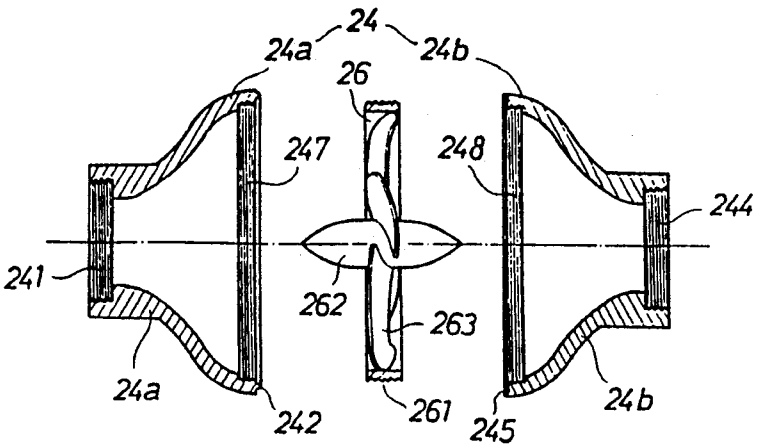
Figure 3:
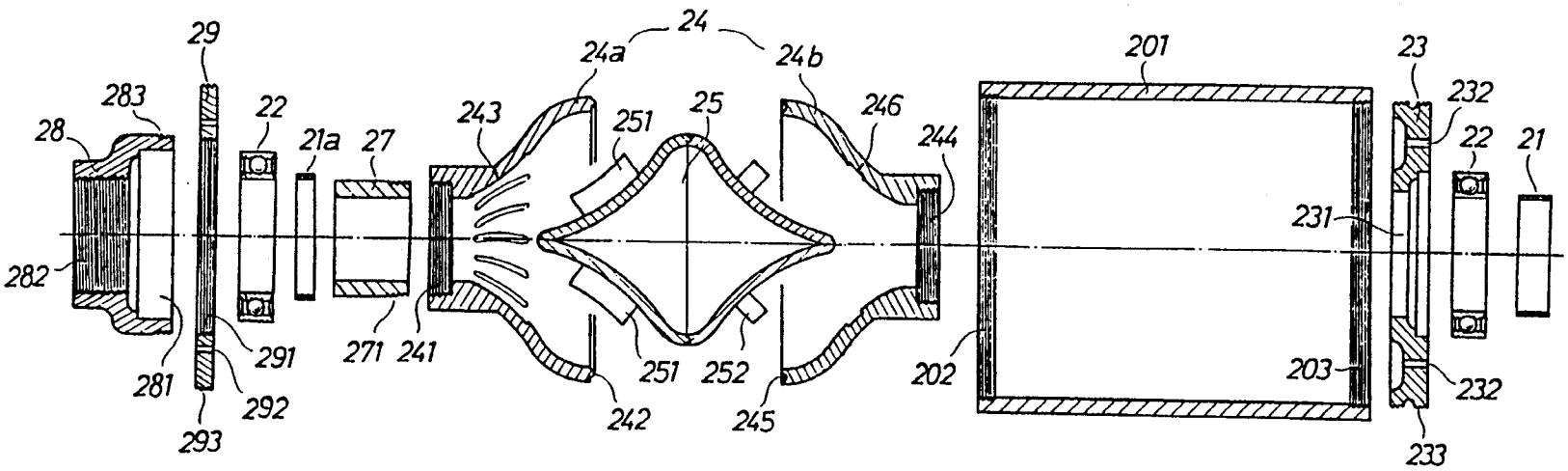
Figure 4B:
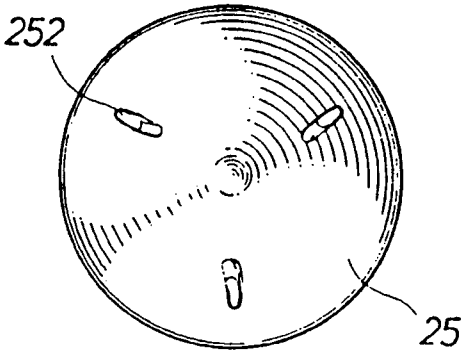
FIG. 4*B* is a back view of the mixed flow impeller of FIG. 1.
Figure 4A:
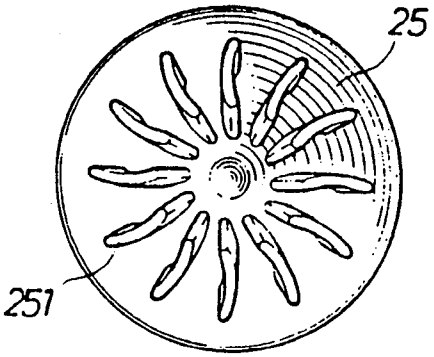
FIG. 4*A* is a front view of the mixed flow impeller of FIG. 1.
Figure 5:
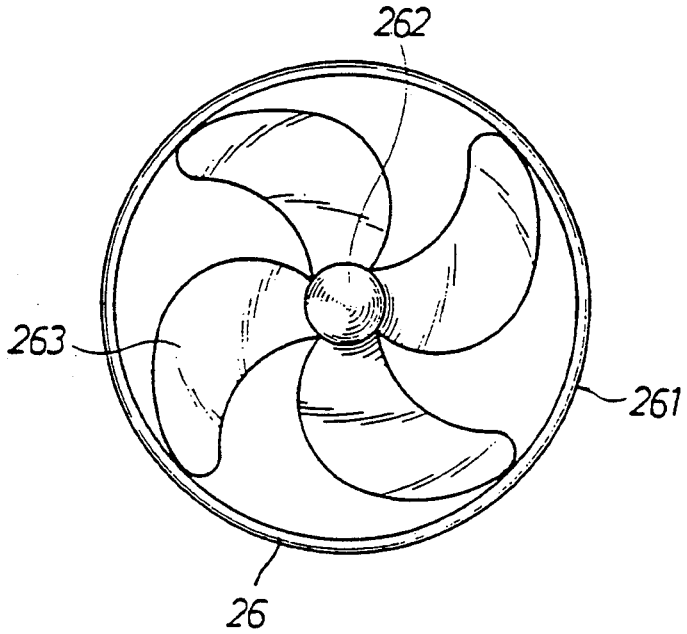
FIG. 5 is a front view of the highly skewed impeller of FIG. 2, and the impeller support thereof.
Figure 7:
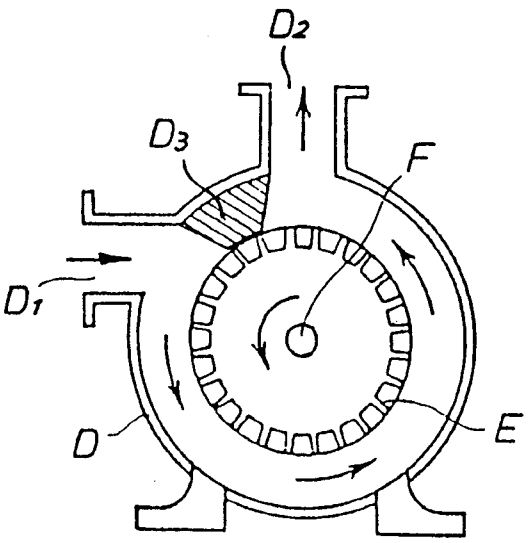
FIG. 7 (PRIOR ART)
FIG. 7 illustrates a conventional cascade pump.
Figure 6:
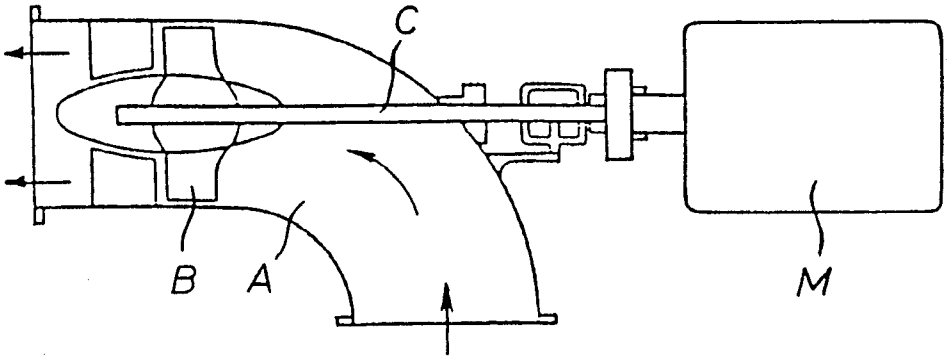
FIG. 6 (PRIOR ART)
FIG. 6 illustrates a conventional impeller pump.

With reference to FIGS. 3 and 3-2, a preferred pump assembly 20 using the mixed flow impeller will now be described.

The mixed flow impeller 251 preferably comprises twelve equally spaced blades mounted on a front section of a somewhat diamond-shaped impeller support 25. A set of preferably three equally spaced fins 252 are also provided on an aft section of the impeller support 25.

The rotatable seat 24 comprises a front portion 24*a* of the seat 24, and a back portion 24*b*. Both portions 24*a* and 24*b* have a circular cross section with a progressively narrowing internal diameter. Internal threads 241 and 244 are respectively disposed at the narrower ends of portions 24*a* and 24*b*. At the wider ends, there is a ring flange 242 on the front portion 24*a*, and a ring groove 245 on the back portion 24*b* capable receiving the ring flange 242. The front and back portions 24*a* and 24*b* are joined together by mating the ring groove 245 with the ring flange 242.

The interior surface of the front portion 24*a* includes twelve equally spaced impeller slots 243. Each of the impeller slots 243 is dimensioned so as to receive the distal tip of one blade of the impeller 251. The interior surface of the back portion 24*b* similarly includes several fin slots 246 for receiving the distal tips of the fins 252.

With reference to FIG. 3-1, a preferred pump assembly 20 using the highly skewed impeller will now be described.

The highly skewed impeller 263 comprises several equally spaced impeller blades radially mounted within a ring-shaped impeller support 26. A guide shaft 262 is disposed at the radial center of the impeller 263. Preferably, the outer circumference of the impeller support 26 includes a set of threads 261.

The rotatable seat 24 comprises a front portion 24*a* a back portion 24*b*. Both portions 24*a* and 24*b* have a circular cross section with a progressively narrowing internal diameter. Internal threads 241 and 244 are respectively disposed at the narrower ends of portions 24*a* and 24*b*. Internal threads 247 and 248 are likewise provided at the wider ends of the portions 24*a* and 24*b*, respectively. The front and back portions 24*a* and 24*b* are joined together by threading the internal threads 247 and 248 onto the set of threads 261 on the circumference of the impeller support 26.

Operation of the tubular shaft motor 10 and pump assemblies will now be described with reference to FIG. 1 and FIG. 2.

With respect to the mixed flow impeller shown in FIG. 1, the pumping process begins with the motor 10 being turned on. Once the motor is activated, the tubular shaft 11 begins to rotate. Likewise, the rotatable seats 24, impeller supports 25, and rotatable sections of pipe 27 all rotate and build up moderate pressure within the fluid path. Consequently, fluids are sucked into one of the delivery pipes 30 (at the left side of the drawing) and pass linearly (from left to right in the drawing) through the rotatable section of pipe 27, the rotatable seat 24, the impeller support 25, the tubular shaft 11, another rotatable seat 24, another impeller support 25, another rotatable section of pipe 27, and out through another delivery pipe 30 (at the right side of the drawing). The fluid flow is moderate pressure and low volume flow. Accordingly, this structure is suitable for pumping to great heights, such as in high-rise buildings or mountainous terrain.

Operation of the tubular shaft motor and pump assembly using the highly skewed impeller will now be described with reference to FIG. 2. The pumping process begins by turning on the motor 10. Once the rotor inside the motor 10 begins to rotate, the tubular shaft 11, rotatable seats 24, impeller supports 26, and rotatable sections of pipe 27 also begin to rotate. During rotation, the impellers 263 inside the impeller support 26 build up moderate pressure in the fluid path. Consequently, fluids are sucked into one of the delivery pipes 30 (at the left side of the drawing) and pass linearly (from left to right in the drawing) through the rotatable section of pipe 27, rotatable seat 24, tubular shaft 11, another rotatable seat 24, another rotatable section of pipe 27, and out through another delivery pipe 30 (at the right side of the drawing). This fluid flow is low pressure and moderate volume flow. Accordingly, this structure is suitable for high volume discharging of fluids such as in irrigation, or the expelling waste water.

I claim:

1. An apparatus for linearly transmitting any combination of gases, liquids and mixed fluids, comprising:
   - a motor having a stationary tubular stator, a rotatable tubular shaft mounted coaxially within said stator, and a tubular rotor connected to said rotatable tubular shaft for rotation therewith, said rotatable tubular shaft being completely hollow so as to define an unobstructed fluid path;
   - at least one rotatable seat having a first end connected in a hermetically sealed manner to an end of the rotatable tubular shaft for rotation therewith, and a second end disposed opposite from the first end;
   - an impeller housed in each rotatable seat for rotation therewith; and
   - means connected to said second end of each rotatable seat, for connecting said rotatable seat to a stationary pipe in a hermetically sealed manner, while allowing said rotatable seat to rotate with respect to said stationary pipe.

2. An apparatus according to claim 1, wherein one of said rotatable seats is connected to each end of the rotatable tubular shaft.

3. An apparatus according to claim 1, wherein said motor is contained in a substantially tubular motor housing having two longitudinal ends and an annular union plate covering at least one of said longitudinal ends, said rotatable tubular shaft projecting through said annular union plate.

4. An apparatus according to claim 3, and further comprising a bearing between said rotatable tubular shaft and said annular union plate to facilitate rotation of the rotatable tubular shaft with respect to the annular union plate.

5. An apparatus according to claim 3, wherein said annular union plate includes at least one cooling vent.

6. An apparatus according to claim 3, wherein each rotatable seat is contained within a substantially tubular housing having the same diameter as the substantially tubular motor housing and being connected thereto by way of said annular union plate, so that a continuous tubular structure is defined by said apparatus.

7. An apparatus according to claim 6, wherein said substantially tubular housing includes an end plate opposite from where the tubular housing connects with said annular union plate.

8. An apparatus according to claim 7, wherein said end plate includes several vent holes.

9. An apparatus according to claim 7, wherein said means for connecting said rotatable seat to a stationary pipe in a hermetically sealed manner, comprises:
   - a rotatable section of pipe connected to and extending out from said rotatable seat oppositely from said motor;
   - a progressively narrowing joint support having a wide diameter end and a small diameter end, said wide diameter end being connected to the end plate, said small diameter end being connected to said stationary pipe, and a bearing disposed within said wide diameter end of the progressively narrowing joint support, and circumferentially around said rotatable section of pipe, so as to facilitate rotation of said rotatable section of pipe with respect to said progressively narrowing joint support.

10. An apparatus according to claim 1, wherein said impeller is a mixed flow impeller.

11. An apparatus according to claim 10, and further comprising:

a somewhat diamond-shaped impeller support having a front section and an aft section, said somewhat diamond-shaped impeller support being contained within said at least one rotatable seat; and a plurality of radially extending fins mounted on the aft section of said somewhat diamond-shaped impeller support and extending out therefrom to connect with said at least one rotatable seat;

said mixed flow impeller comprising a plurality of equally spaced blades mounted on the front section of said somewhat diamond-shaped impeller support and connected to said at least one rotatable seat.

12. An apparatus according to claim 11, wherein said at least one rotatable seat comprises a front portion and a back portion, and wherein said front and back portions have a circular cross section with a progressively narrowing internal diameter, said front and back portions having means for connecting the front and back portions to one another such that the front and back portions connect at their widest internal diameter.

13. An apparatus according to claim 1, wherein said impeller is a highly skewed impeller.

14. An apparatus according to claim 13, and further comprising:

a ring-shaped impeller support disposed around the interior of said at least one rotatable seat; and a guide shaft centrally disposed within said at least one rotatable seat;

wherein said highly skewed impeller comprises a plurality of impeller blades radially extending out from said guide shaft to connect with said ring-shaped impeller support.

15. An apparatus according to claim 14, wherein said at least one rotatable seat comprises a front portion and a back portion, and wherein said front and back portions have a circular cross section with a progressively narrowing internal diameter, said ring-shaped impeller support having means for connecting the front and back portions to one another such that the front and back portions connect at their widest internal diameter.

16. An apparatus for linearly transmitting any combination of gases, liquids and mixed fluids, comprising:

a motor having a substantially tubular motor housing with two longitudinal ends, a stationary tubular stator, a rotatable tubular shaft mounted coaxially within said stator and a tubular rotor connected to said rotatable tubular shaft for rotation therewith, said rotatable tubular shaft being completely hollow so as to define an unobstructed fluid path;

an annular union plate threadedly received in each longitudinal end of the motor housing and having at least one cooling vent, said rotatable tubular shaft projecting through each of said annular union plates;

a bearing between said rotatable tubular shaft and each of said annular union plates to facilitate rotation of the rotatable tubular shaft with respect to each annular union plate;

two rotatable seats, each having a first end connected in a hermetically sealed manner to an end of the rotatable tubular shaft for rotation therewith, and a second end disposed opposite from the first end, each off said rotatable seats being contained in a substantially tubular housing having the same diameter as the substantially tubular motor housing and being threadedly connected thereto by way of said annular union plate, so that a continuous tubular structure is defined by said apparatus;

an end plate threadedly received in each substantially tubular housing, opposite from where the tubular housing connects with said annular union plates, said end plate having at least one vent hole;

an impeller housed in each rotatable seat for rotation therewith; and means connected to said second end of each rotatable seat, for connecting each rotatable seat to a stationary pipe in a hermetically sealed manner, while allowing said rotatable seat to rotate with respect to said stationary pipe, said means for connecting each rotatable seat comprising:

a rotatable section of pipe for each rotatable seat, connected to and extending out from said rotatable seat oppositely from said motor;

a progressively narrowing joint support having a wide diameter end and a small diameter end, said wide diameter end being connected to one of said end plates, said small diameter end being connected to said stationary pipe, and a bearing device disposed within said wide diameter end of the progressively narrowing joint support, and circumferentially around said rotatable section of pipe, so as to facilitate rotation of said rotatable section of pipe with respect to said progressively narrowing joint support.

17. An apparatus according to claim 16, wherein each impeller is a mixed flow impeller, and further comprising:

a somewhat diamond-shaped impeller support having a front section and an aft section, said somewhat diamond-shaped impeller support being contained within each of said rotatable seats; and a plurality of radially extending fins mounted on the aft section of each somewhat diamond-shaped impeller support and extending out therefrom to connect with each of said rotatable seats;

said mixed flow impeller comprising a plurality of equally spaced blades mounted on the front section of said somewhat diamond-shaped impeller supports and connected to said rotatable seats.

18. An apparatus according to claim 16, wherein each impeller is a highly skewed impeller, and further comprising:

a ring-shaped impeller support disposed around the interior of each rotatable seat; and a guide shaft centrally disposed within each rotatable seat;

wherein said highly skewed impeller comprises a plurality of impeller blades radially extending out from the guide shaft to connect with the ring-shaped impeller support.

19. An apparatus according to claim 16, and further comprising:

a first collar disposed concentrically around the rotatable tubular shaft, and between a first one of said bearings and the tubular rotor, to maintain separation between said first one of said bearings and the tubular rotor;

a second collar disposed concentrically around the rotatable tubular shaft, and between a second one of said bearings and a tubular rotor, to maintain separation between said second one of said bearings and the tubular rotor;

a third collar disposed concentrically around a first one of said rotatable sections of pipe, and between a first one of said bearing devices and a first one of said rotatable seats for maintaining separation therebetween; and a fourth collar disposed concentrically around a second one of said rotatable sections of pipe, and between a second one of said bearing devices and a second one of said rotatable seats for maintaining separation therebetween.

* * * * *